US009767977B2

(12) United States Patent
Freimuth et al.

(10) Patent No.: US 9,767,977 B2
(45) Date of Patent: Sep. 19, 2017

(54) FORCE AMPLIFICATION MODULE FOR AN ELECTRICAL SWITCHING DEVICE, UNIT COMPRISING FORCE AMPLIFICATION MODULE AND SHUNT RELEASE, AS WELL AS ELECTRICAL SWITCHING DEVICE

(71) Applicants: Michael Freimuth, Hirschau (DE); Jürgen Renner, Sulzbach-Rosenberg (DE)

(72) Inventors: Michael Freimuth, Hirschau (DE); Jürgen Renner, Sulzbach-Rosenberg (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 13/664,799

(22) Filed: Oct. 31, 2012

(65) Prior Publication Data

US 2013/0106539 A1 May 2, 2013

(30) Foreign Application Priority Data

Nov. 2, 2011 (DE) ..... 10 2011 085 600

(51) Int. Cl.

| | |
|---|---|
| ***H01H 71/24*** | (2006.01) |
| ***H01H 71/02*** | (2006.01) |
| ***H01H 71/12*** | (2006.01) |
| ***H01H 73/36*** | (2006.01) |
| *H01H 3/30* | (2006.01) |
| *H01H 83/20* | (2006.01) |

(52) U.S. Cl.

CPC ..... *H01H 71/0228* (2013.01); *H01H 71/12* (2013.01); *H01H 71/2463* (2013.01); *H01H 73/36* (2013.01); *H01H 3/30* (2013.01); *H01H 2083/205* (2013.01)

(58) Field of Classification Search

CPC ..... H01H 71/12; H01H 73/36; H01H 71/2463
USPC ..... 335/21, 172, 174–176
See application file for complete search history.

(56) References Cited

U.S. PATENT DOCUMENTS 6,853,278 B2 * 2/2005 Baldauf et al. ..... 335/172
2002/0153238 A1 10/2002 Baldauf et al.
(Continued)

FOREIGN PATENT DOCUMENTS

CN 201285741 Y 8/2009
CN 201417726 Y 3/2010
DE 2105646 A1 8/1972
(Continued)

OTHER PUBLICATIONS

Office Action for Chinese Patent Application No. 201210432298.4 issued on Sep. 17, 2015 and English translation thereof.
(Continued)

*Primary Examiner* — Ramon M Barrera
(74) *Attorney, Agent, or Firm* — Harness, Dickey & Pierce, P.L.C.

(57) ABSTRACT

A force amplification module is disclosed for an electrical switching device, in particular a circuit-breaker, that is designed to amplify the release force of a shunt release which is designed to switch off the electrical switching device. A unit including a shunt release and the force amplification module for an electrical switching device is also disclosed, as well as an electrical switching device.

11 Claims, 3 Drawing Sheets

(56) References Cited

U.S. PATENT DOCUMENTS

| | | | | |
|---|---|---|---|---|
| 2009/0237190 | A1* | 9/2009 | Nyzner | 335/174 |
| 2010/0288611 | A1 | 11/2010 | Freimuth et al. | |

FOREIGN PATENT DOCUMENTS

| | | | |
|---|---|---|---|
| DE | 2439813 | A1 | 3/1976 |
| DE | 10254038 | A1 | 6/2004 |
| DE | 102009021754 | A1 | 11/2010 |
| WO | WO 2004/047137 | | 6/2004 |
| WO | WO 2010088875 | A1 | 8/2010 |
| WO | WO-2011027120 | A2 | 3/2011 |

OTHER PUBLICATIONS

Office Action for Chinese Patent Application No. 201210432298.4 issued on Sep. 21, 2016 and English translation thereof.

* cited by examiner

FORCE AMPLIFICATION MODULE FOR AN ELECTRICAL SWITCHING DEVICE, UNIT COMPRISING FORCE AMPLIFICATION MODULE AND SHUNT RELEASE, AS WELL AS ELECTRICAL SWITCHING DEVICE

PRIORITY STATEMENT

The present application hereby claims priority under 35 U.S.C. §119 to German patent application number DE 10 2011 085 600.5 filed Nov. 2, 2011, the entire contents of which are hereby incorporated herein by reference.

FIELD

At least one embodiment of the invention generally relates to a force amplification module for an electrical switching device, in particular a circuit-breaker, which is designed to amplify the release force of a shunt release which is designed to switch off the electrical switching device. At least one embodiment of the invention further generally relates to a unit comprising a shunt release and such a force amplification module for an electrical switching device, as well as an electrical switching device.

BACKGROUND

The role of electrical switching devices, such as circuit-breakers, is to decouple a number of consumers from a voltage supply network when a particular fault occurs. The classic fault is the occurrence of a short-circuit current, and circuit-breakers are conventionally designed to move a contact element in the event of such a short-circuit current and thus decouple the connection between consumers and voltage supply network.

However, such a decoupling of consumers and voltage supply network is further also desirable in other situations. In particular, it may be that in the event of an undervoltage in the voltage supply network, the voltage supply network is disconnected from the consumers. In order to provide a functionality for this, shunt releases are used. This means that circuit-breakers, in particular compact circuit-breakers, can be switched off with the aid of shunt releases. These are preferably electromagnetic releases, which usually have an energy store and which trip either in the presence of a voltage (open-circuit shunt releases) or when a critical voltage is undershot (undervoltage releases). Open-circuit shunt releases also include direct-acting electromagnetic releases which work without an additional energy store.

Such shunt releases are typically designed as a module which can be attached to a recess, for example a bay, of the circuit-breaker. Part of the release mechanism in a circuit-breaker is traditionally a latching mechanism. Shunt releases act precisely on this latching mechanism or on a contact element of the latching mechanism and thus effect a decoupling of the consumer from the voltage supply network by the circuit-breaker. To this end they are fitted with a mechanical release element, e.g. a plunger. The release element, namely in particular the plunger, is retracted in a non-released state. For release the release element travels out of a housing of the shunt release.

Circuit-breakers or compact circuit-breakers vary considerably in size. They differ essentially in their current-carrying capacities and thus significantly in their size. Large compact circuit-breakers require larger energy stores in the shunt releases, to be able to conduct and switch high currents. In order to release a large compact circuit-breaker, for example an MCCB (MCCB=Molded Case Circuit Breaker) by means of a shunt release, a higher release energy is thus also required.

In consequence different sizes of shunt release also exist for different sizes of circuit-breaker. Although these do not need to be assigned explicitly to each size of circuit-breaker, nonetheless no supplier of circuit-breakers currently uses exactly the same shunt release for every size of circuit-breaker. The reasons for this are as follows:

- Differing requirements for forces and paths for releasing a circuit-breaker,
- Small circuit-breakers require less release energy and a restricted installation space, whereas large circuit-breakers need a higher release energy and more installation space,
- Different interfaces for release and for reset.

SUMMARY

At least one embodiment of the present invention is directed to a universally usable shunt release of a single size in different sizes of electrical switching devices, in particular circuit-breakers. Likewise different sizes of electrical switching devices, in particular circuit-breakers, may be created, which can be easily and flexibly coupled to a standardized shunt release.

Disclosed are a force amplification module for an electrical switching device, a unit comprising shunt release and force amplification module, as well as an electrical switching device. In this case features and details which are described in connection with at least one embodiment of the inventive force amplification module of course also apply in connection with at least one embodiment of the inventive unit and at least one embodiment of the inventive electrical switching device, and vice versa in each case, so that reciprocal reference is and can always be made to the individual aspects of the invention in respect of the disclosure.

According to a first aspect of at least one embodiment of the invention, a force amplification module is disclosed for an electrical switching device, in particular a circuit-breaker, wherein the force amplification module is designed to amplify the release force of a shunt release, which is designed to switch off the electrical switching device.

BRIEF DESCRIPTION OF THE DRAWINGS

Example embodiments of the invention are explained in greater detail below with reference to the attached figures. In the figures.

In the various FIGS. 1 to 6 identical parts are always provided with the same reference character. The description applies for all figures in which the corresponding part can likewise be identified.

DETAILED DESCRIPTION OF THE EXAMPLE EMBODIMENTS

Figure 1:
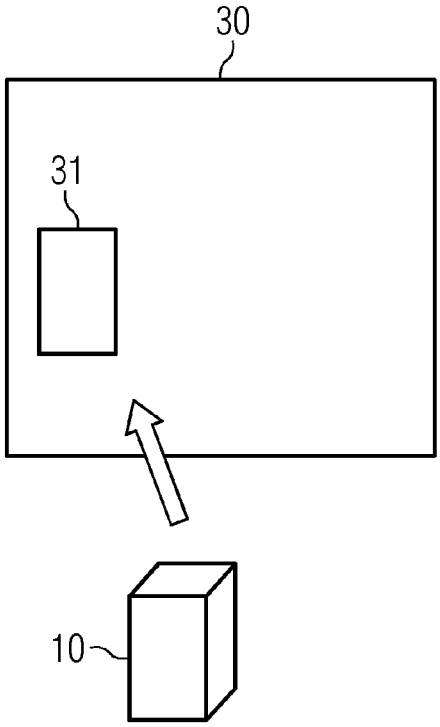
FIG 1 Prior art
FIG. 1 shows a schematic illustration of an electrical switching device with a recess for accommodating a shunt release according to the prior art.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

According to a first aspect of at least one embodiment of the invention, a force amplification module is disclosed for an electrical switching device, in particular a circuit-breaker, wherein the force amplification module is designed to amplify the release force of a shunt release, which is designed to switch off the electrical switching device.

A force amplification module of this type makes it possible to increase the release force of a shunt release, in order to safely release large electrical switching devices, in particular electrical switching devices with differing current-carrying capacities, when a particular voltage is applied or when a critical voltage is undershot.

The force amplification module for a shunt release can optionally be used in large electrical switching devices, such as compact circuit-breakers. In other words, a shunt release designed for small sizes does not directly release a large electrical switching device, for example a large compact circuit-breaker, but a force amplification module which then in turn releases the electrical switching device, for example a large compact circuit-breaker.

Advantages provided by a force amplification module of this type are that the shunt release can be universally used across all sizes of device, in particular sizes of circuit-breaker, that no additional parts are needed in the electrical switching device, in particular in the circuit-breaker, and thus no additional costs are incurred there, and that large quantities of the shunt releases can be produced in a smaller size.

The force amplification module enables a shunt release to be supplemented as necessary. The size of the force amplification module itself can differ in this case, and in particular can amplify the release force of a shunt release to a different extent. In other words, the force amplification module is designed to amplify the release force of a shunt release, which is designed to switch off the electrical switching device. If the release force of a shunt release is insufficient to release a particular electrical switching device, in particular a compact circuit-breaker, this can be affected by the supplementary force amplification module. In this case the force amplification module is coupled to the shunt release such that the shunt release releases the force amplification module, which in turn releases the electrical switching device, in particular the compact circuit-breaker. In this case the release force of the force amplification module exceeds the release force of the shunt release. Advantageously the release force of the force amplification module is a multiple of that of the shunt release.

According to an example development of the invention provision can be made for a force amplification module to have an energy store with at least three interfaces, wherein a first interface can be connected to an actuating device, in particular to an actuating device of the electrical switching device, such that the energy store can be charged with energy by the actuating device, in particular of the electrical switching device, wherein a second interface can be connected to the shunt release such that the energy store can be released by the shunt release, and that a third interface can be designed such that after the energy store has been released by the shunt release the energy stored in the energy store of the force amplification module can be transmitted to the release mechanism of the electrical switching device to release a release mechanism of the electrical switching device.

The energy store of the force amplification module is designed to store energy. This means it can store the energy fed to it and if need be can supply it again. Energy can be fed via a first interface of the force amplification module to the energy store, which is in particular designed as a spring element, preferably as a compression spring. For example, energy can be fed to the energy store by an external operating handle, such as a lever, or by a rotor shaft. Thus a spring element used as an energy store can be pretensioned by an operating handle or a rotor shaft. In this case the energy store is mechanically wound up. The energy store is here designed such that it stores the energy fed to it. In other words, the energy store can be charged with energy via the one first interface.

In the example of the spring element, the spring element remains in the pretensioned position until the pretensioning is released again by an external pulse. This external pulse can be fed to the energy store via the one second interface. The one second interface of the force amplification module can be connected to the shunt release such that the energy store of the force amplification module can be released by the shunt release, in particular an energy store of the shunt release. To transmit a release pulse from the shunt release to the force amplification module use is made of the one second interface of the force amplification module. The force amplification module and a shunt release can be operatively coupled to one another via this second interface. Preferably the second interface is designed such that a mechanical pulse can be transmitted to the energy store of the force amplification module from the shunt release, in particular from an energy store of the shunt release, such that the energy stored in the energy store of the force amplification module is released.

The at least one third interface of the force amplification module is designed such that after the energy store of the force amplification module is released by the shunt release the energy stored in the energy store of the force amplification module can be transmitted to the release mechanism of the electrical switching device to release a release mechanism of the electrical switching device. This means that after the energy of the energy store of the force amplification module is released by a pulse from the shunt release, the stored energy in the energy store of the force amplification module can be supplied, via the one third interface, to the electrical switching device, in particular the circuit-breaker.

Because the stored energy of the energy store of the force amplification module is greater than that of the energy store of the auxiliary store, it is possible for the latching mechanism of a large electrical switching device, in particular of a compact circuit-breaker which has a high current-carrying capacity, to be released by way of the combination of shunt release and force amplification module. The one third interface of the force amplification module is here preferably coupled to a release mechanism of the electrical switching device such that after the stored energy in the energy store is released a mechanical pulse can be transmitted from the energy store of the force amplification module to the release mechanism of the electrical switching device.

The energy store of the force amplification module can be variously designed. The energy store enables energy to be stored and released. In particular, the energy store of the force amplification module is designed such that it stores energy in a first position or in a first status. This can be an idle state. On receipt of a pulse from the shunt release the stored energy in the energy store of the force amplification module can be supplied, via the one third interface, to the electrical switching device, in particular the circuit-breaker. While energy is being supplied to the electrical switching device the energy store switches from the first position or from the first status to a second position or a second status. An actuating device is required to return to the first position or the first status, known as the reset.

According to an example development of the invention provision can be made in the case of a force amplification module for the energy store to be designed as a spring element, in particular as a compression spring. In the first position or in a first status the spring element stores energy. In the case of a compression spring this can be affected by compressing the compression spring. This means in the first position the compression spring is compressed and thus stores the spring energy. After a mechanical pulse is sent by the shunt release to the energy store of the force amplification module, the stored energy of the spring element can be released. This released energy enables a latching mechanism of an electrical switching device, in particular of a compact circuit-breaker, to be switched via the third interface.

The energy store of the shunt release can be charged externally with energy. A force amplification module which has a fourth interface via which the energy store of the shunt release can be charged with energy is preferred. This means that according to a development of at least one embodiment of the invention the energy store of the shunt release can be charged with energy via the force amplification module. To this end the force amplification module has a fourth interface. The at least one second interface and the fourth interface can be coupled to one another. In this case the energy store of the shunt release and the energy store of the force amplification module can be charged with energy simultaneously. This procedure is also known as reset.

The first interface of the force amplification module is designed such that the energy store of the force amplification module can be charged with energy via the first interface. Particularly preferred is a force amplification module in which the first interface is designed for connection to an actuating device, in particular to an operating handle or a rotor, of the electrical switching device, wherein the energy store of the force amplification module can be charged with energy, in particular pretensioned, via the actuating device. As a result, the energy store of the force amplification module can easily be charged. The connection of the energy store of the force amplification module to an actuating device of the electrical switching device, in particular of a compact circuit-breaker, enables the energy store of the force amplification module to be reset easily and quickly to its first, i.e. charged, position.

According to a further example development of an embodiment of the invention, provision can be made in the case of a force amplification module for the second interface to be designed to connect to a release device of the shunt release, so that after the shunt release is released the energy store of the force amplification module can be released by the release device. This enables the energy stored in the energy store of the shunt release to be used to release the energy store of the force amplification module. The force amplification module can be coupled to the shunt release via the second interface. As a result, the functionality of the shunt release can be used to the full. This means that a shunt release which in the case of small electrical switching devices is sufficiently large to itself switch the latching mechanism of a small electrical switching device can now be used to switch the force amplification module, which in turn because of its larger energy store compared to the shunt release can switch a larger electrical switching device, such as for example a compact circuit-breaker.

According to a second aspect of an example embodiment of the invention the object is achieved by a unit comprising force amplification module and shunt release for an electrical switching device, in particular a circuit-breaker, wherein the force amplification module is designed according to the first aspect of the invention and wherein the shunt release has a release device for releasing the energy store of the force amplification module. This means that a unit having a shunt release and a previously described force amplification module enables electrical switching devices, in particular circuit-breakers, of the widest range of sizes to be switched. Where switching an electrical switching device by a standardized shunt release is no longer possible, the unit can effect the switching. Thanks to the unit comprising shunt release and force amplification module it is ensured that larger electrical switching devices, such as compact circuit-breakers, can be safely switched when a fault occurs. Thus such a unit ensures that larger electrical switching devices, such as compact circuit-breakers, can be safely released if a particular fault occurs, for example an undervoltage in the voltage supply network to which the electrical switching device is connected. At least one embodiment of the inventive unit enables a latching mechanism or a contact element of the electrical switching device connected to the unit to be moved, in order thus to decouple the connection between a consumer and the voltage supply network.

A unit of this type can be universally used in electrical switching devices. Depending on the size and current-carrying capacity of an electrical switching device it is possible to select the size of the force amplification module which is coupled to a shunt release to form the unit. The shunt release can be standardized in the case of such a unit. This means the shunt release can always be the same size, since the energy of the energy store of the shunt release is merely required for releasing the energy store of the force amplification module. The force amplification module then takes over the release of the electrical switching device. As a result a single size of shunt release can be universally used in all sizes of electrical switching device. Depending on the size of an electrical switching device only the size of the force amplification module of the unit comprising shunt release and force amplification module has to be adjusted. The shunt release can always be the same size regardless of the size of the electrical switching device to be switched. As a result the manufacturing process of the shunt release can be standardized. Thanks to the universal usability of a standardized shunt release across all sizes of switching device, in particular sizes of circuit-breaker, a cost saving can be achieved in the manufacture of shunt releases. Standardized here means that the size of the unit is harmonized or adjusted for all units. This means that the combination of a shunt release with a force amplification module enables the shunt release to be manufactured in large quantities in a small size. As a result the manufacture of shunt releases can be standardized. The connection of the shunt release to different sizes of force amplification module enables the release of the widest range of sizes of electrical switching device.

The shunt release of the unit can act on the energy store of the force amplification module via the second interface of the force amplification module and so effect a release of the energy store. To this end the shunt release is advantageously fitted with a release element, e.g. a plunger. The release element, namely in particular the plunger, is retracted in a non-released state. For release the release element travels out of the shunt release, in particular a housing of the shunt release. According to an example development of the invention provision can be made in a unit for the shunt release to have an electromagnet to actuate the energy store of the shunt release. The electromagnet is advantageously coupled to the release element, namely in particular to the plunger, such that the latter can be moved by the electromagnet. In the event of a fault, for example the occurrence of a short-circuit, the electromagnet moves the release element, in particular the plunger, out of the housing of the shunt release, so that the latter can trigger, in particular release, the energy store of the force amplification module via the second interface of the force amplification module.

The shunt release of a unit is preferably designed as an open-circuit shunt release or an undervoltage release. A shunt release designed as an undervoltage release reacts when a minimum supply voltage is undershot. A shunt release designed in this way can be used to switch off electrical devices, machines and systems when the voltage is too low and to prevent them starting up again automatically after a voltage failure. This means that in the case of the unit comprising shunt release and force amplification module such a shunt release releases the energy store of the force amplification module when a voltage in the voltage supply network drops, and the energy store in turn, because of its larger stored force, releases the latching mechanism or contact element of a connected electrical switching device, in particular of a compact circuit-breaker. After the voltage has been restored the electrical switching device must be switched on again manually. It cannot be switched on in the absence of a sufficient supply voltage. As a result an undesired and uncontrolled restart of a consumer after the return of the supply voltage can be prevented. Furthermore, such a unit can protect electric motors running under load from an overload in consequence of reduced power and in systems supplied by batteries can prevent an exhaustive discharge of the battery. The release voltage can be set advantageously in the case of the shunt release designed as an undervoltage release.

As an alternative to the undervoltage release the shunt release of the unit can be designed as an open-circuit shunt release. A shunt release designed in this way can be used for remote release if a voltage interruption is not to result in the automatic switch-off of an electrical switching device. The open-circuit shunt release can have an electromagnet which when a particular voltage is applied or a particular voltage is exceeded actuates the energy store of the force amplification module.

Preferably provision can be made for a unit to have a housing with a standardized size for connecting the unit to an electrical switching device, in particular to a circuit-breaker. Such a unit comprising shunt release and force amplification module can be easily and quickly mounted on a corresponding electrical switching device, such as a compact circuit-breaker. Thanks to the standardized size of the unit it can easily be inserted into a corresponding recess, for example designed as a plug-in unit, of an electrical switching device. Hence it is preferable if the housing of such a unit is designed to be accommodated in a recess of an electrical switching device.

The interfaces of a shunt release correspond in shape, size and function to at least the first and the third interface of the force amplification module, so that depending on the size of an electrical switching device, the shunt release or the force amplification module for releasing the electrical switching device can optionally be connected to the electrical switching device.

According to a third aspect of an embodiment of the invention the object is achieved by an electrical switching device which at least has interfaces for connection to the first and third interface of a force amplification module according to an embodiment of the first aspect of the invention, which module has an actuating device, in particular an operating handle or a rotor shaft, via which the energy store of the force amplification module can be charged with energy, in particular pretensioned, and which has a release mechanism for switching off the electrical switching device. An electrical switching device designed in this way permits universal usability of shunt releases of a single size. Because the electrical switching device has interfaces for connection to the first and third interface of a previously described force amplification module, a force amplification module can be connected to the electrical switching device. The connection of the force amplification module in turn enables the use of a shunt release for releasing the energy store of the force amplification module.

The electrical switching device has an actuating device, in particular an operating handle or a rotor shaft, via which the energy store of the force amplification module can be charged with energy, in particular pretensioned. The actuating device is advantageously designed to reset the electrical switching device. This actuating device can further be used to reset the force amplification module, in other words to charge the energy store of the force amplification module, as well as to reset the shunt release, in other words to charge the energy store of the shunt release. The first and where appropriate the fourth interface of the force amplification module are used for this. Via these interfaces it is possible for the actuating device to charge the energy store of the force amplification module and where appropriate the energy store of the shunt release with energy with energy. Furthermore, the electrical switching device has a release mechanism for switching off the electrical switching device. This is connected to the force amplification module via the second interface of the force amplification module. When the energy store of the force amplification module is released the release mechanism of the electrical switching device can be actuated via the second interface of the force amplification module, resulting in a switch-off of the electrical switching device.

According to an example development of an embodiment of the invention provision can be made for the electrical switching device to have a recess for accommodating and for connecting a unit comprising force amplification module and shunt release, which is designed according to the second aspect of an embodiment of the invention. The recess of the electrical switching device is in particular designed for force-fit and/or form-fit accommodation of the unit comprising shunt release and force amplification module. The unit is preferably designed as a plug-in unit which can be inserted into the recess of the electrical switching device designed as a bay. In the mounted, inserted state of the unit at the recess at least the first and the third interface of the force amplification module of the unit are operatively connected to complementary interfaces of the electrical switching device, so that energy can be supplied to the energy store of the force amplification module and dissipated from the energy store of the force amplification module via these interfaces.

Attachment elements such as screws, clamps, etc., on the unit, in particular the housing of the shunt release and/or of the force amplification module, can be provided to fix the unit. Preferably the size and shape of the unit corresponds to that of the recess of the electrical switching device, so that in the fixed state the unit is protected by the electrical switching device.

The electrical switching device is preferably designed as a circuit-breaker, in particular as a compact circuit-breaker. The role of such circuit-breakers is to decouple consumers from a voltage supply network when a particular fault occurs. The classic fault is the occurrence of a short-circuit current, and the circuit-breakers are conventionally designed to move a latching mechanism or a contact element in the event of such a short-circuit current and thus to decouple the connection between consumers and voltage supply network.

FIG. 1 shows a schematic illustration of an electrical switching device 30 with a recess 31 for accommodating a shunt release 10 according to the prior art. The shunt release 10 can be inserted into the recess 31 designed as a bay. The electrical switching device 30 is used to decouple a consumer from a network. In particular it may be that in the absence of a voltage in the voltage supply network or in the case of an undervoltage in the voltage supply network the latter is to be disconnected from the consumers. In order to provide a functionality for this, shunt releases 10 are used. Such shunt releases 10 are typically designed as a plug-in unit which can be inserted into the recess 31 of the electrical switching device 30, in particular of a circuit-breaker. Part of the release mechanism in an electrical switching device 30, such as a circuit-breaker, is traditionally a latching mechanism. The shunt release 10 can act on precisely this latching mechanism and thus effect a decoupling from the voltage supply network by the electrical switching device 30. To this end the shunt releases 10 are fitted with a release element, e.g. a plunger. The release element, namely in particular the plunger, is retracted in a non-released state. For release the release element travels out, in particular out of a housing of the shunt release 10.

Figure 3:
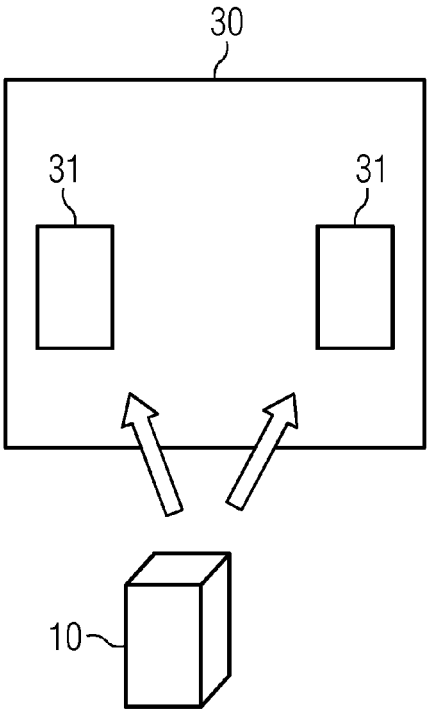
FIG 3 Prior art
FIG. 3 shows a schematic illustration of an electrical switching device with recesses for accommodating auxiliary switches according to the prior art.

FIG. 3 shows a schematic illustration of an electrical switching device 30 with two recesses 31 for accommodating two shunt releases 10 according to the prior art.

A disadvantage of the electrical switching devices 30 according to FIGS. 1 and 3 is that different sizes of shunt release 10 are required for different sizes of electrical switching device 30. This means that the shunt releases 10 must have a high variance, as a result of which they are cost-intensive.

Figure 2:
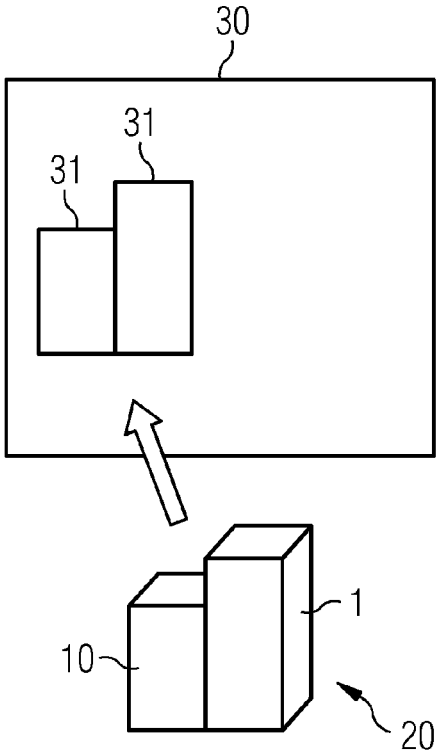
FIG. 2 shows a schematic illustration of an electrical switching device with a recess for accommodating a unit comprising shunt release and force amplification module, which is designed according to an embodiment of the inventive design principle.
Figure 4:
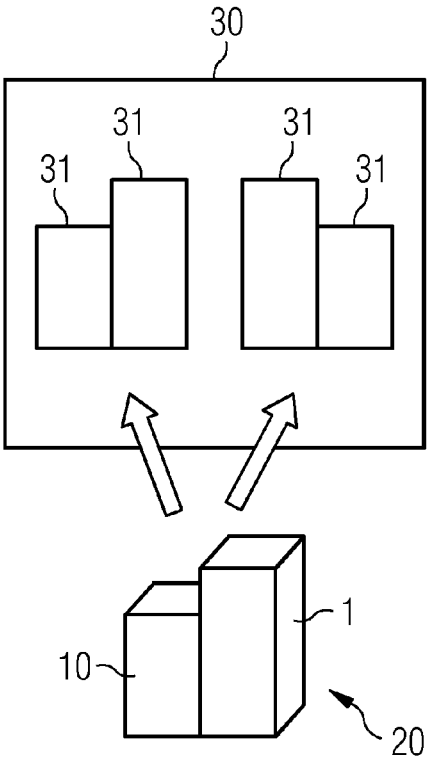
FIG. 4 shows a schematic illustration of an electrical switching device with recesses for accommodating units comprising shunt releases and force amplification modules, which are designed according to an embodiment of the inventive design principle.

FIG. 2 shows a schematic illustration of an electrical switching device 30 with a recess 31 for accommodating a unit 20 comprising shunt release 10 and force amplification module 1, which is designed according to an embodiment of the inventive design principle. FIG. 4 shows a schematic illustration of an electrical switching device 30 with two recesses 31 for accommodating two units 20 comprising shunt releases 10 and force amplification modules 1, which are designed according to the inventive design principle. A unit 20 is in each case formed from a shunt release 10 and a force amplification module 1.

The force amplification module 1 enables the release force of the shunt release 10 to be increased, in order to safely release large electrical switching devices 30, in particular electrical switching devices with differing current-carrying capacities, when a particular voltage is applied or when a critical voltage is undershot. The force amplification module 1 can optionally be used as an add-on to a shunt release 10 in large electrical switching devices 30, such as compact circuit-breakers. The shunt release 10 designed for small electrical switching devices 30 does not directly release a large electrical switching device 30, for example a large compact circuit-breaker, but releases the force amplification module 1 of the unit 20, which then in turn releases the large electrical switching device 30, for example the large compact circuit-breaker. In the case of large electrical switching devices 30, in particular compact circuit-breakers, the force amplification module 1 can be coupled to a standardized small shunt release 10 to form a unit 20, via which the large electrical switching device 30, in particular the compact circuit-breaker, can then be released in the presence of a fault, in order to disconnect at least one consumer from the voltage supply network. It is advantageous here that the shunt release 10 can be standardized. This means that the same shunt release 10 can always be used for releasing a release mechanism of an electrical switching device 30, regardless of the size of the electrical switching device 30. In larger electrical switching devices 30, in particular compact circuit-breakers, for which the release power of the shunt release 10 is insufficiently large, the inventive force amplification module 1 can be added to the shunt release 10, so that the larger electrical switching devices 30 can be released by the unit 20 comprising shunt release 10 and force amplification module 1. By adding the force amplification module 1 a standardized shunt release 10 can be used across all sizes of switching device, in particular sizes of circuit-breaker. Thus large quantities of the shunt release 10 can be produced in a smaller size, as a result of which production costs of the shunt release 10 can be kept low.

An inventive force amplification module 1 can, as necessary, be added to a standardized shunt release 10 in order to amplify the release force of the shunt release 10. Because the force amplification module 1 is technically simpler in design than a shunt release 10, costs can be saved thanks to the resulting unit 20, compared to manufacturing large shunt releases 10 which require a high release force for releasing a large electrical switching device 30.

The force amplification module 1 can, as necessary, supplement a shunt release 10. In this case the force amplification module 1 itself can be of different sizes, in particular can amplify the release force of a shunt release 10 to a different extent. This means the force amplification module 1 is designed to amplify the release force of a shunt release 10. If the release force of a standardized shunt release 10 is insufficient to release a large electrical switching device 30, in particular a compact circuit-breaker, this can thus be affected by the supplementary force amplification module 1. In this case the force amplification module 1 is coupled to the shunt release 10 such that the shunt release 10 releases the force amplification module 1, which in turn releases the electrical switching device 30, in particular the compact circuit-breaker. In this case the release force of the force amplification module 1 exceeds the release force of the shunt release 10. Advantageously the release force of the force amplification module 1 is a multiple of the release force of the shunt release 10.

Figure 5:
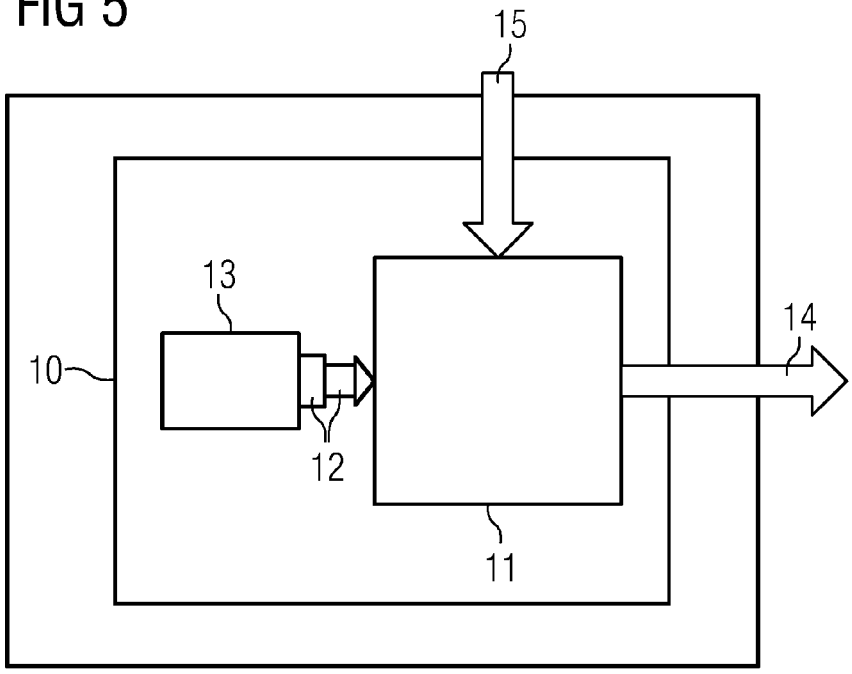
FIG. 5 shows a schematic illustration of a shunt release.

FIG. 5 shows a schematic illustration of a shunt release 10. The shunt release 10 has an energy store 11. The shunt release 10 further has a release device 12 for releasing the energy store 11. The release device 12 can be actuated by an electromagnet 13. The release device 12, e.g. a plunger, serves to release the force stored in the energy store 11. The release device 12, namely in particular the plunger, is in a non-released state retracted in the direction of the electromagnet 13. For release the release device 12 travels into the energy store 11. The energy store 11 further has a release device 14, via which the energy stored in the energy store 11 can be supplied to a force amplification module (not shown). Such a shunt release 10 can also be used solely for releasing a small electrical switching device 30. In this case the energy store 11 does not release the energy store of a force amplification module via the release device 14, but directly switches a latching mechanism of a small electrical switching device 30. Energy can be supplied to the energy store 11 via the interface 15. The energy store 11 is preferably designed as a spring element. Furthermore, electrical energy for operating the shunt release 10, in particular the electromagnet 13, can be supplied to the shunt release 10.

Figure 6:
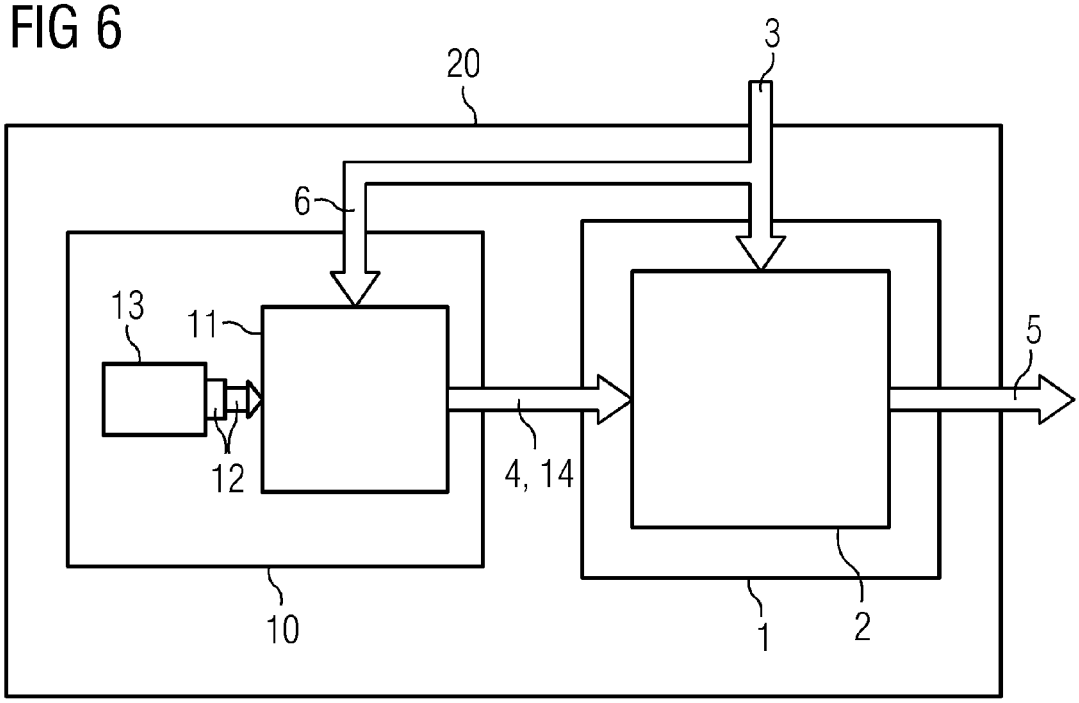
FIG. 6 shows a schematic illustration of a unit comprising shunt release and force amplification module for an electrical switching device, which is designed according to an embodiment of the inventive design principle.

FIG. 6 schematically shows a unit 20 comprising shunt release 10 and force amplification module 1 for an electrical switching device 30 which is designed according to an embodiment of the inventive design principle. Coupling the force amplification module 1 to the shunt release 10 produces a unit which also enables larger electrical switching devices 30, such as for example compact circuit-breakers, to be released. The standardized shunt release 10 now switches the electrical switching device 30 not directly but indirectly. This means the standardized shunt release 10 releases the energy store 2 of the force amplification module 1 in the presence of a fault, for example a short-circuit, which in turn releases the electrical switching device 30 via the third interface 5 to the electrical switching device 30. The energy store 11 of the shunt release 10 is connected to the energy store 2 of the force amplification module 1 via the interface 14 of the energy store 11 or the second interface 4 of the force amplification module 1.

The force amplification module 1 has an energy store 2 with at least three interfaces 3, 4, 5, wherein a first interface 3 can be connected to an actuating device, in particular to an actuating device of the electrical switching device 30, such that the energy store 2 can be charged with energy by the actuating device, in particular of the electrical switching device 30. The second interface 4 can be connected to the shunt release 10 such that the energy store 2 can be released by the shunt release 10. The third interface 5 is designed such that after the energy store 2 is released by the shunt release 10 the energy stored in the energy store of the force amplification module 1 for releasing a release mechanism of the electrical switching device 30 can be transmitted to the release mechanism of the electrical switching device 30.

The energy store 2 of the force amplification module 1 is designed to store energy. Energy can be supplied to the energy store 2, which in particular is designed as a spring element, for example as a compression spring or tension spring, by way of an actuating device via the first interface 3 of the force amplification module 1. For example, energy can be supplied to the energy store 2 by an external operating handle, such as a lever, or by a rotor shaft. The one second interface 4 of the force amplification module 1 can be connected to the shunt release 10 such that the energy store 2 of the force amplification module 1 can be released by the shunt release 10, in particular an energy store 11 of the shunt release 10. The second interface 4 of the force amplification module 1 and the interface 14 of the shunt release 10 are used to transmit a release pulse from the shunt release 10 to the force amplification module 1. The force amplification module 1 and the shunt release 10 can be operatively coupled to one another via this second interface and the interface 14 of the shunt release 10. The second interface 4 and the interface 14 of the shunt release 10 are advantageously designed such that a mechanical pulse can be transmitted from the shunt release 10, in particular from an energy store 11 of the shunt release 10, to the energy store 2 of the force amplification module 1 such that the energy stored in the energy store 2 of the force amplification module 1 is released.

The at least one third interface 5 of the force amplification module 1 is designed such that after the energy store 2 of the force amplification module 1 is released by the shunt release 10 the energy stored in the energy store 2 of the force amplification module 1 for releasing a release mechanism of the electrical switching device 30 can be transmitted to the release mechanism of the electrical switching device 30. This means that after the energy of the energy store 2 of the force amplification module 1 is released by a pulse from the shunt release 10 the stored energy in the energy store 2 of the force amplification module 1 can be supplied thereby to the electrical switching device 30, in particular a compact circuit-breaker, via the one third interface 5. The stored energy of the energy store 2 of the force amplification module 1 exceeds the stored energy of the shunt release 10, so that it is possible to release the latching mechanism of a large electrical switching device 30, in particular of a compact circuit-breaker which has a high current-carrying capacity, by means of the unit 20 comprising shunt release 10 and force amplification module 1.

The energy store 2 of the force amplification module 1 enables energy to be stored and to be released. In particular, the energy store 2 of the force amplification module 1 is designed as a spring element, in particular as a compression spring.

The force amplification module 1 has a fourth interface 6, via which the energy store 11 of the shunt release 10 can be charged with energy. In particular, the energy store 11 of the shunt release 10 is connected via this fourth interface 6 to an actuating device of the connected electrical switching device 30, so that it can be charged with energy, just like the energy store 2 of the force amplification module 1, via the actuating device, such as an operating handle or a rotor shaft.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE CHARACTERS

1 Force amplification module
2 Energy store
3 (First) interface
4 (Second) interface
5 (Third) interface
6 (Fourth) interface
10 Shunt release
11 Energy store

12 Release device
13 Electromagnet
14 Release device
15 Interface
20 Unit comprising shunt release and force amplification module
21 Housing
30 Electrical switching device
31 Recess

What is claimed is:

1. A unit, comprising:

a force amplification module including a first housing;

a first energy store within the first housing, the first energy store including at least three interfaces, a first of the three interfaces being connectable to an actuating device of an electrical switching device such that the first energy store is chargeable with energy by the actuating device, a second of the three interfaces being connectable to a shunt release, located outside of and upstream from the first housing via an opening in the first housing, such that the first energy store is releasable by the shunt release, and a third of the three interfaces being connectable to the electrical switching device such that after the first energy store is released via the second interface, the energy stored in the first energy store of the force amplification module for releasing a release mechanism of the electrical switching device is transmittable to the release mechanism of the electrical switching device; wherein the shunt release includes a second housing;

an electromagnet within the second housing;

a release device, downstream of the electromagnet, within the second housing and operatively connected to the electromagnet; and a second energy store, downstream of the electromagnet and the release device, within the second housing and operatively connected to the release device and the force amplification module, wherein the release device is configured to impinge upon the second energy store of the shunt release to release the first energy store of the force amplification module; wherein the second housing is a standardized size and is attachable to an exterior surface of the first housing, the first and second housings being configured to be insertable into a correspondingly sized recess in a surface of the electrical switching device to connect the at least one unit to the electrical switching device.

2. The unit of claim 1, wherein the first energy store of the force amplification module is a spring element.

3. The unit of claim 1, wherein the force amplification module includes a fourth interface, via which the second energy store of the shunt release is chargeable with energy.

4. The unit of claim 1, wherein the first housing includes an opening that receives a release device of the shunt release, so that after the shunt release is released, the first energy store of the force amplification module is releasable by the release device.

5. The unit of claim 1, wherein the electromagnet actuates the second energy store of the shunt release.

6. The unit of claim 1, wherein the shunt release is an open-circuit shunt release or an under voltage release.

7. An electrical switching device, comprising:

a third housing;

a first recess in a surface of the third housing that receives the first housing of claim 1;

a standardized sized second recess in the surface of the electrical switching device that accommodates and connects to the second housing of claim 1;

at least interfaces for connection to the first and the third interface of the force amplification module of claim 1;

an actuating device, via which the first energy store of the force amplification module is chargeable with energy; and a release mechanism configured to switch off the electrical switching device.

8. The electrical switching device of claim 7, wherein the recess of the electrical switching device is designed for at least one of a force-fit and form-fit accommodation of the unit.

9. The electrical switching device of claim 7, wherein the electrical switching device is a circuit-breaker.

10. The unit of claim 1, wherein the first energy store of the force amplification module is designed as a compression spring.

11. The unit of claim 1, wherein the electrical switching device is a circuit-breaker.

* * * * *